US012635756B2

(12) United States Patent
Zach et al.

(10) Patent No.: US 12,635,756 B2
(45) Date of Patent: May 26, 2026

(54) PROTECTIVE SHOE

(71) Applicant: UVEX ARBEITSSCHUTZ GMBH, Fürth (DE)

(72) Inventors: Julian Zach, Fürth (DE); Laurent Rebstock, Nuremberg (DE)

(73) Assignee: UVEX ARBEITSSCHUTZ GMBH, Fürth (DE)

( * ) Notice: Subject to any disclaimer, the term of this patent is extended or adjusted under 35 U.S.C. 154(b) by 0 days.

(21) Appl. No.: 18/848,247

(22) PCT Filed: Mar. 22, 2023

(86) PCT No.: PCT/EP2023/057295

§ 371 (c)(1),
(2) Date: Sep. 18, 2024

(87) PCT Pub. No.: WO2023/180365

PCT Pub. Date: Sep. 28, 2023

(65) Prior Publication Data

US 2025/0204646 A1 Jun. 26, 2025

(30) Foreign Application Priority Data

Mar. 23, 2022 (DE) ..... 10 2022 202 833.3

(51) Int. Cl.
*A43B 3/24* (2006.01)
*A43B 23/08* (2006.01)

(52) U.S. Cl.
CPC ..... *A43B 3/246* (2013.01); *A43B 3/24* (2013.01); *A43B 23/081* (2013.01)

(58) Field of Classification Search
CPC ..... A43B 3/24; A43B 3/244; A43B 3/246; A43B 13/36; A43B 19/00; A43B 5/1616; A43B 23/081
See application file for complete search history.

(56) References Cited

U.S. PATENT DOCUMENTS

| | | | | | |
|---|---|---|---|---|---|
| 1,823,924 | A | | 9/1931 | Williams | |
| 2,742,715 | A | | 4/1956 | Meltzer | |
| 3,037,304 | A | | 6/1962 | Duffy | |
| 4,257,177 | A | | 3/1981 | Unsted | |
| 4,706,316 | A | * | 11/1987 | Tanzi | A43B 9/12 12/146 D |
| 5,822,888 | A | * | 10/1998 | Terry | A43B 3/0047 36/77 R |
| 5,855,079 | A | * | 1/1999 | Herbert | A43B 3/0047 36/117.6 |

(Continued)

FOREIGN PATENT DOCUMENTS

| | | | |
|---|---|---|---|
| EP | 0239313 | A2 | 9/1987 |
| EP | 3302131 | A1 | 4/2018 |
| KR | 20160129549 | A | 11/2016 |

*Primary Examiner* — Ted Kavanaugh
(74) *Attorney, Agent, or Firm* — FISHERBROYLES, LLP; Roger L. Browdy; Ronni S. Jillions

(57) ABSTRACT

A protective shoe comprises an upper for receiving a shoe wearer's foot, a sole arrangement connected to the upper, and a toe cap, and also at least one connecting and indicating arrangement, which, in the original, integral state, indicates an integrity of the protective shoe, and, when the protective shoe is at least partially dismantled, indicates the dismantling of the protective shoe.

15 Claims, 13 Drawing Sheets

(56) References Cited

U.S. PATENT DOCUMENTS

Figure 1:
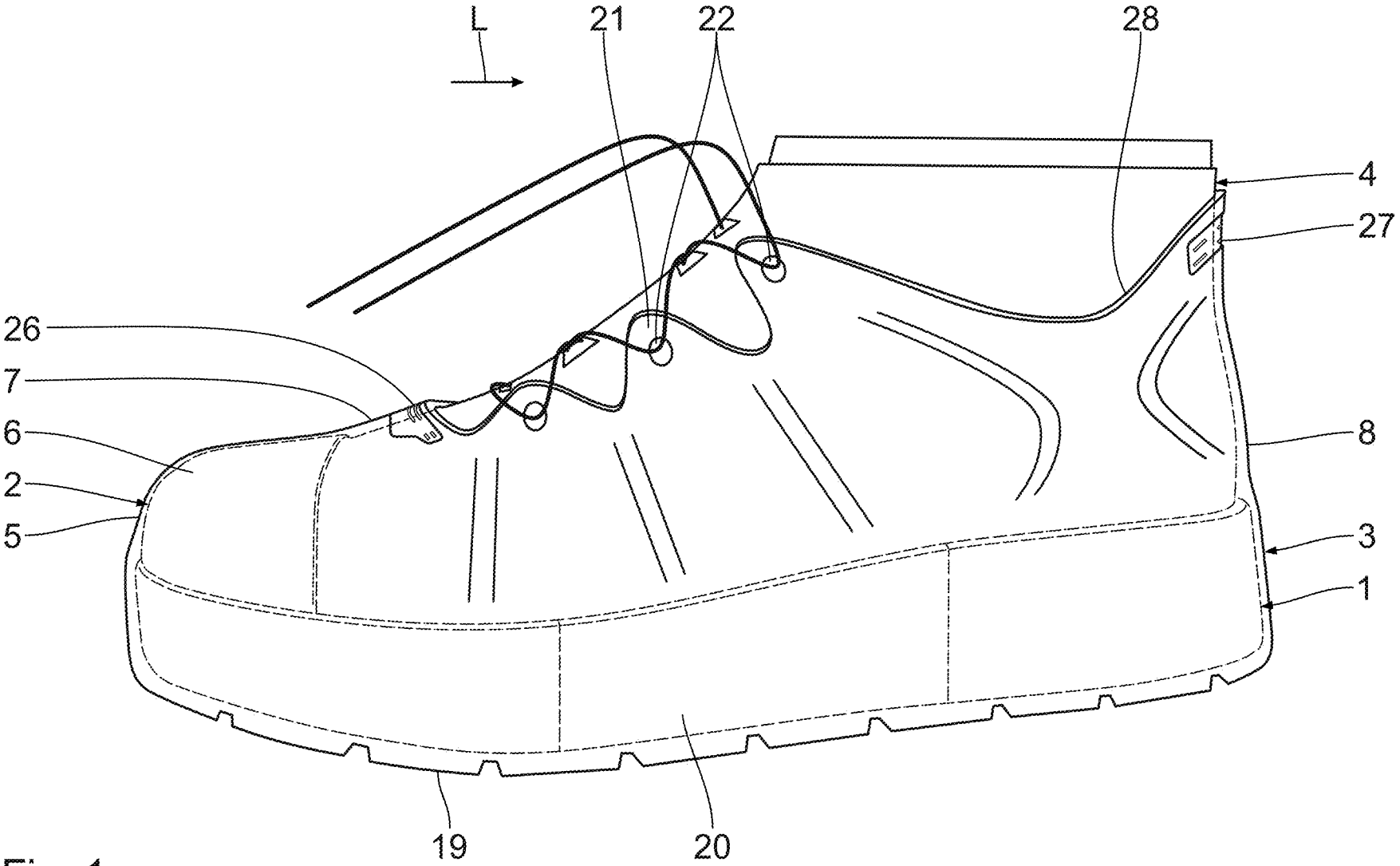

| | | | | |
|---|---|---|---|---|
| 6,467,192 | B1 * | 10/2002 | Egtvedt | A43B 3/18 36/117.6 |
| 2003/0097770 | A1 * | 5/2003 | Karasawa | A43B 3/06 36/97 |
| 2007/0000150 | A1 * | 1/2007 | Covatch | A43B 7/32 36/100 |
| 2007/0062067 | A1 * | 3/2007 | Covatch | A43B 23/07 36/55 |
| 2007/0227038 | A1 * | 10/2007 | Edington | A43B 23/07 36/10 |
| 2007/0251125 | A1 | 11/2007 | Dun | |
| 2008/0134543 | A1 | 6/2008 | Kanji et al. | |
| 2009/0100713 | A1 * | 4/2009 | Adami | A43B 5/02 36/133 |
| 2012/0011744 | A1 * | 1/2012 | Bell | A43B 23/0245 36/91 |
| 2013/0145651 | A1 * | 6/2013 | Bathum | A43B 17/18 36/43 |
| 2018/0177262 | A1 | 6/2018 | Islas Mares | |
| 2019/0116916 | A1 * | 4/2019 | Burch | A43B 19/00 |
| 2021/0015202 | A1 * | 1/2021 | Lai | A43B 13/41 |
| 2021/0196004 | A1 * | 7/2021 | Burnett | A43B 9/06 |

* cited by examiner

PROTECTIVE SHOE

The present patent application claims the priority of German patent application DE 10 2022 202 833.3, the content of which is incorporated herein by reference.

The invention relates to a protective shoe, which is in the form for example of a protective work shoe or a safety shoe.

Protective shoes are generally known from the prior art through prior public use. Frequently, these protective shoes have the disadvantage that it is not possible, or it is possible only to a small extent, to recycle their constituent parts. The protective shoes generally consist of a wide variety of materials or constituent parts, which are also connected to one another in different ways.

The invention is based on the object of overcoming the disadvantages of the prior art. The particular intention is to provide a protective shoe which can be recycled in especially sustainable fashion and to an extremely high extent, preferably completely. The integrity of the protective shoe should also be identifiable, in particular from the outside.

This object is achieved, in a non-obvious way, by A protective shoe comprising an upper for receiving a shoe wearer's foot, a sole arrangement connected to the upper, a toe cap, and at least one connecting and indicating arrangement, which, in an original, integral state, indicates an integrity of the protective shoe, and when the protective shoe is at least partially dismantled, indicates the dismantling of the protective shoe.

According to the invention, it has been found that at least one connecting and indicating arrangement makes it possible to indicate an integrity of the protective shoe. It can thus be identified, for example, that the protective shoe is in its original state, which is to say whole or unchanged. The protective shoe can be dismantled or disassembled, in particular for recycling purposes.

The at least one connecting and indicating arrangement can be produced by machine or by hand.

The protective shoe is in the form for example of a high-leg shoe or a boot. As an alternative, it is in the form for example of a low shoe. It is expedient if the protective shoe in the assembled state complies with the safety class S1, S1P, S2, S3, S4 or S5. For example, it is at least partially waterproof. It is expedient if the protective shoe alternatively or additionally is at least partially breathable.

The upper preferably forms a top part of the protective shoe. It has a height corresponding to the configuration of the protective shoe as a high-leg shoe/boot or low shoe. The upper preferably comprises a front cap, tongue and/or rear cap. It is expedient if the upper has or bears at least one closure means, in order to hold it on the shoe's wearer or to make it easier to put the protective shoe on and/or take it off. For example, the inner side of the upper at least partially has a lining or padding. Expediently, the upper has an outer material which is completely closed or at least partially open. The sole arrangement preferably forms a bottom part of the protective shoe. It comprises for example, in addition to the midsole, an inner sole, topsole, insole and/or outsole. The sole arrangement is for example multi-layered or multi-part.

Further advantageous configurations are specified in the dependent claims.

In one embodiment, the at least one connecting and indicating arrangement is formed as a seam arrangement. The at least one connecting and indicating arrangement according to this embodiment is produced for example under pressure and/or heat. It preferably forms a welded connection or weld seam. The at least one connecting and indicating arrangement can be produced quickly and economically, in particular by machine. As an alternative, it is produced for example by sewing.

In one embodiment, the at least one connecting and indicating arrangement at least partially tears open when the shoe is being dismantled. The at least one connecting and indicating arrangement according to this embodiment allows an easily and clearly identifiable and functionally reliable indication of the at least partial dismantling of the protective shoe. The indication is preferably irreversible.

In one embodiment, the at least one connecting and indicating arrangement is elongate. The at least one connecting and indicating arrangement according to this embodiment again allows an easily and clearly identifiable and functionally reliable indication of the at least partial dismantling of the protective shoe. A connection established by the at least one connecting and indicating arrangement is functionally reliable and is able to bear loads.

When dismantling the protective shoe, it is preferably necessary to dismantle the inner shoe first. Only then is it preferably possible to dismantle further constituent parts of the protective shoe. The at least one connecting and indicating arrangement preferably indicates the dismantling of the protective shoe as early as when the inner shoe is being dismantled.

According to some embodiments, at least one first connecting and indicating arrangement is arranged adjacent to the toe cap in an instep region of the protective shoe, is spaced apart from the toe cap, and is arranged in the instep region between the toe cap and a closure arrangement. The at least one first connecting and indicating arrangement according to these embodiments can be readily identified from the outside, for example by a wearer of the shoe or another person. According to some embodiments, at least one second connecting and indicating arrangement is arranged in a rear region of the protective shoe and is arranged adjacent to an upper free edge of the upper. The same applies for the at least one second connecting and indicating arrangement according to these embodiments.

According to one embodiment, different uppers are usable with the protective shoe. The protective shoe according to this embodiment can be designed in different ways. It preferably has the same sole arrangement as a basis. This allows particularly economic manufacture and is user-friendly.

According to one embodiment, the at least one connecting and indicating arrangement is formed as a sealing means. The sealing means according to this embodiment is, for example, continuous or interrupted. It has, for example, a single sealing element or individual sealing elements, which are for example at a spacing from one another. The individual sealing elements are for example identical or different. The sealing means is preferably spatially delimited.

The sealing means comprises for example at least one logo or embroidery as sealing element. The sealing element may at least partially cover, or overlap, certain regions of at least one seam of the protective shoe. The sealing element is formed for example by at least partially sewing over the respective seam.

As an alternative or in addition, the sealing means can comprise for example at least one sealing weld, seal, sealing patch, sealing stud, sealing rivet, sealing label, sealing cord, sealing lace, sealing shoelace, sealing holder or the like.

According to one embodiment, the at least one connecting and indicating arrangement is formed as a sealing seam arrangement. According to this embodiment, the at least one connecting and indicating arrangement is in the form of a sealing seam arrangement. For example, the sealing seam arrangement may be formed by at least one thread or seam, which can be clearly, for example uniquely, or specifically/especially, identified. For example, the at least one thread or the at least one seam has at least one special mark. This thread or seam has for example a specific electrical charge or color. It is for example magnetized and/or carries specific information. For example, it can be electrically/electronically read out. As an alternative or in addition, the sealing seam arrangement has a unique, or specific/special, form or shape. It comprises for example a logo, a trade mark or the like.

The sealing means or sealing seam arrangement indicates, in particular in the original or undamaged state, the integrity of the protective shoe. It then indicates in particular that the protective shoe has not been at least partially dismantled. It may in particular be designed to indicate whether the protective shoe has been manipulated, in particular at least partially dismantled or damaged. It is advantageous if the sealing means or sealing seam arrangement is permanent during use. It can preferably be modified when the protective shoe is returned, for example to the manufacturer and/or to an authorized location, and/or when the protective shoe is repaired by the manufacturer and/or an authorized location.

It is expedient if the sealing means or sealing seam arrangement acts only as a seal. In particular, the sealing means or sealing seam arrangement does not provide a fixed or retaining connection between different components of the protective shoe.

The sealing means or sealing seam arrangement may in particular not have a structurally connecting and/or load-bearing function.

For example, the sealing means or sealing seam arrangement tears open or breaks when a component of the protective shoe, such as an inner shoe, a toe cap and/or a midsole, is dismantled or removed. In general, the sealing means, in particular the sealing seam arrangement, may be designed such that it indicates an action deviating from normal use of the shoe on the shoe, in particular on the connection between different components of the shoe, in particular by a change, in particular destruction.

It can in particular form a connection, in particular in the form of a predetermined breaking point, between two components of the protective shoe, for example between an inner shoe, a toe cap and/or a midsole and an upper and/or a sole of the shoe, wherein this connection does not have a function, in particular a load-bearing or holding function, when the shoe is being used normally.

The sealing means may in particular form a connection, in particular in the form of a predetermined breaking point, between two components of the protective shoe, for example between an inner shoe, a toe cap and/or a midsole and an upper and/or a sole of the shoe, wherein these two components are structurally connected to one another, in particular robustly connected to one another, by a connection independent thereof. The two components may in particular, in addition to the sealing means, be form-fittingly and/or force-fittingly connected to one another.

The sealing means in particular has a strength which is lower than the strength of the additional connection between the two components. The ratio of the strength, in particular the tear resistance, of the additional connection to that of the sealing connection may be in particular at least 1.5:1, in particular at least 2:1, in particular at least 3:1, in particular at least 5:1, in particular at least 10:1.

The sealing means may in particular be designed such that dismantling of at least one specific component of the shoe, for example dismantling of an inner shoe, of a sole, in particular of an insole, or of a toe cap, is not possible without modification, in particular without destruction of the sealing means.

The sealing means or sealing seam arrangement may for example be fastened to or formed on an upper and/or an inner shoe. It is in the form for example of a sealing label, which is fastened to the upper and the inner shoe. As an alternative, the sealing means or sealing seam arrangement is fastened to the upper adjacent to an upper opening for a foot and at least partially encircles the latter. In particular, use is then made of a sealing cord or sealing lace, which bears or has for example a seal. As an alternative or in addition, damage or destruction is effected by at least one sealing-element holder or carrier for holding or carrying a sealing element or connecting element. For example, the sealing element is in the form of a sealing shoelace, which tears or breaks when an inner shoe, a toe cap and/or midsole is removed. It is in the form for example of a sealing cord, sealing lace or the like, which extends adjacent to shoelace openings and tears or breaks when an inner shoe, a toe cap and/or a midsole is removed.

The midsole of the sole arrangement, or of the protective shoe, is subdivided in particular in a longitudinal direction into at least two midsole components. It preferably has at least one connecting element, which extends in the longitudinal direction and connects the midsole components to one another. It has been found that a subdivision of the midsole into in particular individual, such as one to five, midsole components and at least one connecting element which connects them, in particular detachably or non-detachably, to one another allows particularly straightforward and good recycling. This furthermore also makes it possible for example to repair, customize, such as in technical and/or optical terms, and space-savingly transport or store individual constituent parts of the midsole. The midsole is modular.

The midsole may also be formed in one piece. It may in particular be composed of one element, in particular consist of one element.

A puncture-resistant means, in particular a textile puncture-resistant means, may be part of the midsole or a separate element. The puncture-resistant means may in particular be connected to the shoe, in particular to an inner shoe. It may in particular be connected to the bottom side of the upper, in particular by means of a Strobel seam.

The at least one connecting element is preferably at least partially arranged in/on the midsole components.

It is expedient if the at least one connecting element extends at least between adjacently arranged midsole components. This at least one connecting element is correspondingly arranged on/in adjacently arranged midsole components and preferably projects/protrudes beyond them.

Expediently, each connecting element connects all of the midsole components to one another. This midsole is particularly easy to mount or manufacture. There is preferably only a single connecting element.

The at least one connecting element is preferably, in particular completely, arranged inside the midsole components. This configuration results in a midsole which is particularly stable, or able to bear loads.

The at least one connecting element preferably provides puncture resistance. This midsole provides a wearer of the shoe with particularly high protection. It is extremely safe.

It is expedient if the at least one connecting element is sole-like. This midsole allows a particularly secure connection, which is particularly able to bear loads, between the midsole components. It also provides very high wearing comfort.

The midsole components are preferably originally formed separately from one another. These midsole components differ for example in form, function, material and/or hardness.

It is advantageous if the midsole components are plugged on the at least one connecting element. This midsole can be recycled particularly well. It can in particular be disassembled again well.

The at least one connecting element is preferably injection molded into the midsole components, and preferably beforehand at least partially wetted with a release agent. This midsole can be produced particularly well and efficiently by machine.

It is expedient if each midsole component has at least one connecting element receptacle, in which the respective at least one connecting element is received.

Each connecting element receptacle and the connecting element received therein preferably at least partially correspond to one another. This configuration again results in a midsole which is particularly able to bear loads.

The midsole expediently comprises a front midsole component and a rear midsole component. It is expedient if this midsole moreover also comprises at least one intermediate midsole component.

The midsole preferably comprises a toe cap, which is arranged on the front midsole component. The front midsole component and the toe cap are for example connected to one another in one piece and integrally. They are detachably or non-detachably connected to one another.

The front midsole component is preferably formed by injection molding and the toe cap is conjointly molded, in particular using a release agent. This midsole can be produced particularly economically. The toe cap is for example molded on or in the front midsole component.

It is expedient if the protective shoe comprises an upper for receiving a shoe wearer's foot and a sole arrangement which is connected to the upper and, in the assembled state of the protective shoe, is latchingly connected to the upper via at least one first latching arrangement.

The protective shoe preferably comprises an upper for receiving a shoe wearer's foot and a sole arrangement which, in the assembled state of the protective shoe, is connected to the upper, and also a toe cap which, in the assembled state of the protective shoe, is latchingly connected to the upper via at least one second latching arrangement.

It has also been found that, for a protective shoe, a latching arrangement or latching connection both allows a secure, and in particular low-play/play-free, connection between individual constituent parts of the protective shoe and also re-detachment thereof from one another, and this for example enables straightforward, separate recycling of the constituent parts. In particular, this makes it possible for constituent parts or materials which are identical to be recycled again, and this allows secondary materials to be recovered. Material utilization is ensured. It is possible to repair, customize, such as in technical and/or visual terms, and space-savingly transport or store individual constituent parts of the protective shoe.

It is expedient if the at least one first latching arrangement has at least one latching means arranged or formed on/in the upper and at least one mating latching means arranged or formed on/in the sole arrangement. They preferably complement one another and, in the latching connection, they preferably interact with, in particular are form-fittingly connected to, one another. A reverse arrangement is alternatively possible.

The at least one second latching arrangement preferably has at least one latching means arranged or formed on/in the upper and at least one mating latching means arranged or formed on/in the toe cap. They preferably complement one another and, in the latching connection, they preferably interact with, in particular are form-fittingly connected to, one another. A reverse arrangement is alternatively possible.

The at least one first latching arrangement is preferably situated in a front, middle and/or rear region of the protective shoe. The at least one first latching arrangement is arranged for example in a toe, middle and/or heel region of the protective shoe.

It is expedient if the at least one first latching arrangement forms a latching connection between a midsole of the sole arrangement and the upper. This configuration allows for the one part a secure connection between the midsole and the upper. For the other part, however, it also makes it possible to separate the midsole and the upper from one another.

It is advantageous if the at least one first latching arrangement has at least one first latching surface, which in the assembled state of the protective shoe extends adjacent to at least one mating latching surface of the midsole, on the inside of the upper. This design results in a protective shoe which is visually extremely attractive owing to the at least one inner first latching surface and enables a functionally reliable latching connection between the sole arrangement and the upper. The at least one first latching surface is preferably spatially delimited laterally outward, which is to say away from a foot space of the protective shoe. It expediently is not spatially delimited, or is open, laterally inward, which is to say toward the foot space. For example, there are multiple first latching surfaces which extend at a spacing, obliquely, perpendicularly and/or offset in relation to one another. The at least one first latching surface and mating latching surface of the midsole make contact preferably in the assembled state of the protective shoe at least partially, preferably extensively.

The at least one first latching surface preferably at least partially faces downward.

It is expedient if the at least one first latching surface extends around at least 60%, preferably around at least 70%, preferably around at least 80%, preferably around at least 90% of the upper. The at least one first latching surface surrounds, or encircles, the upper at least partially or in certain regions. It is preferably endless and encircles/surrounds the foot space preferably completely. Expediently, the at least one first latching surface always faces downward, which is to say toward an outsole in the assembled state of the protective shoe.

The at least one first latching surface is preferably assigned at least one mounting insertion aid. The at least one mounting insertion aid results in a protective shoe which can be mounted or put together particularly straightforwardly and securely. It is formed for example by at least one flank, surface or the like which extends from the top inward, for example in a straight line or with a curve, toward the foot space. The at least one mounting insertion aid is preferably arranged above and adjacent to the at least one first latching surface. In particular, the sole arrangement or midsole can thus be mounted or inserted easily.

The protective shoe preferably comprises an outer shell, which at least partially surrounds the midsole and at least partially forms the upper. The outer shell preferably forms an outsole. It preferably (also) forms the upper. Such a protective shoe provides its wearer with particularly high protection, such as against the ingress of liquid.

It is expedient if the at least one first latching surface is formed on the outer shell.

The at least one second latching arrangement preferably has at least one second latching surface, which extends adjacent to at least one mating latching surface of the toe cap, on the inside of the upper. This design results in a protective shoe which is visually extremely attractive owing to the at least one inner second latching surface and enables a functionally reliable latching connection between the toe cap and the upper. The at least one second latching surface is preferably spatially delimited laterally outward, which is to say away from a foot space of the protective shoe. It expediently is not spatially delimited, or is open, laterally inward, which is to say toward the foot space. For example, there are multiple second latching surfaces which extend at a spacing, obliquely, perpendicularly and/or offset in relation to one another. The at least one second latching surface and mating latching surface of the toe cap make contact preferably in the assembled state of the protective shoe at least partially, preferably extensively.

It is advantageous if the at least one second latching surface at least partially faces forward. The at least one second latching surface faces toward a shoe tip, or a toe region, of the protective shoe. It preferably exclusively faces forward.

The at least one second latching surface is preferably formed at least in an instep region of the upper. The at least one second latching surface is thus situated, for example, on a front vamp of the protective shoe.

The at least one second latching surface expediently adjoins the sole arrangement to the side in the assembled state of the protective shoe.

The at least one second latching surface extends preferably in an arc. The at least one second latching surface is for example (substantially) U-shaped, in the form of a circular arc or the like.

It is advantageous if the at least one second latching surface is formed on an outer shell of the protective shoe.

The protective shoe preferably comprises at least one connecting and indicating arrangement, which in the original, integral state indicates an integrity of the protective shoe and, when the protective shoe is at least partially dismantled, indicates the dismantling of the protective shoe. It has been found that at least one connecting and indicating arrangement makes it possible to indicate an integrity of the protective shoe. It can thus be identified, for example, that the protective shoe is in its original state, which is to say whole or unchanged. The protective shoe can be dismantled or disassembled, in particular for recycling purposes.

The at least one connecting and indicating arrangement can be produced by machine or by hand.

It is advantageous if the at least one connecting and indicating arrangement is in the form of a seam arrangement, in particular a sealing seam arrangement. This at least one connecting and indicating arrangement is produced for example under pressure and/or heat. It preferably forms a welded connection or weld seam. The at least one connecting and indicating arrangement can be produced quickly and economically, in particular by machine. As an alternative, it is produced for example by sewing.

The at least one connecting and indicating arrangement preferably at least partially tears open on dismantling. This at least one connecting and indicating arrangement allows an easily and clearly identifiable and functionally reliable indication of the at least partial dismantling of the protective shoe. The indication is preferably irreversible.

It is expedient if the at least one connecting and indicating arrangement is elongate. This at least one connecting and indicating arrangement again allows an easily and clearly identifiable and functionally reliable indication of the at least partial dismantling of the protective shoe. A connection established by the at least one connecting and indicating arrangement is functionally reliable and is able to bear loads.

The at least one connecting and indicating arrangement is preferably arranged on an inner shoe and/or an outer shell of the protective shoe. It connects preferably in the original, integral state an inner shoe and an outer shell of the protective shoe fixedly, but detachably to one another. It is advantageous if the at least one connecting and indicating arrangement indicates a removal of the toe cap, of an inner shoe, of a midsole of the sole arrangement, and/or of a unit composed of the toe cap and the midsole. When dismantling the protective shoe, it is preferably necessary to dismantle the inner shoe first. Only then is it preferably possible to dismantle further constituent parts of the protective shoe. The at least one connecting and indicating arrangement preferably indicates the dismantling of the protective shoe as early as when the inner shoe is being dismantled.

The protective shoe preferably has at least one first connecting and indicating arrangement, which is arranged adjacent to the toe cap in an instep region of the protective shoe. Expediently, the at least one first connecting and indicating arrangement is at a spacing from the toe cap. It is expedient if the at least one first connecting and indicating arrangement is arranged in the instep region between the toe cap and a closure arrangement. This at least one first connecting and indicating arrangement can be readily identified from the outside, for example for a wearer of the shoe or another person.

The protective shoe preferably has at least one second connecting and indicating arrangement, which is arranged in a rear region of the protective shoe. The at least one second connecting and indicating arrangement is preferably arranged adjacent to an upper free edge of the upper. This at least one first connecting and indicating arrangement can be readily identified from the outside, for example for a wearer of the shoe or another person.

It is advantageous if different uppers can be used. This protective shoe can be designed in different ways. It preferably has the same sole arrangement as a basis. This allows particularly economic manufacture and is user-friendly.

Figure 2:
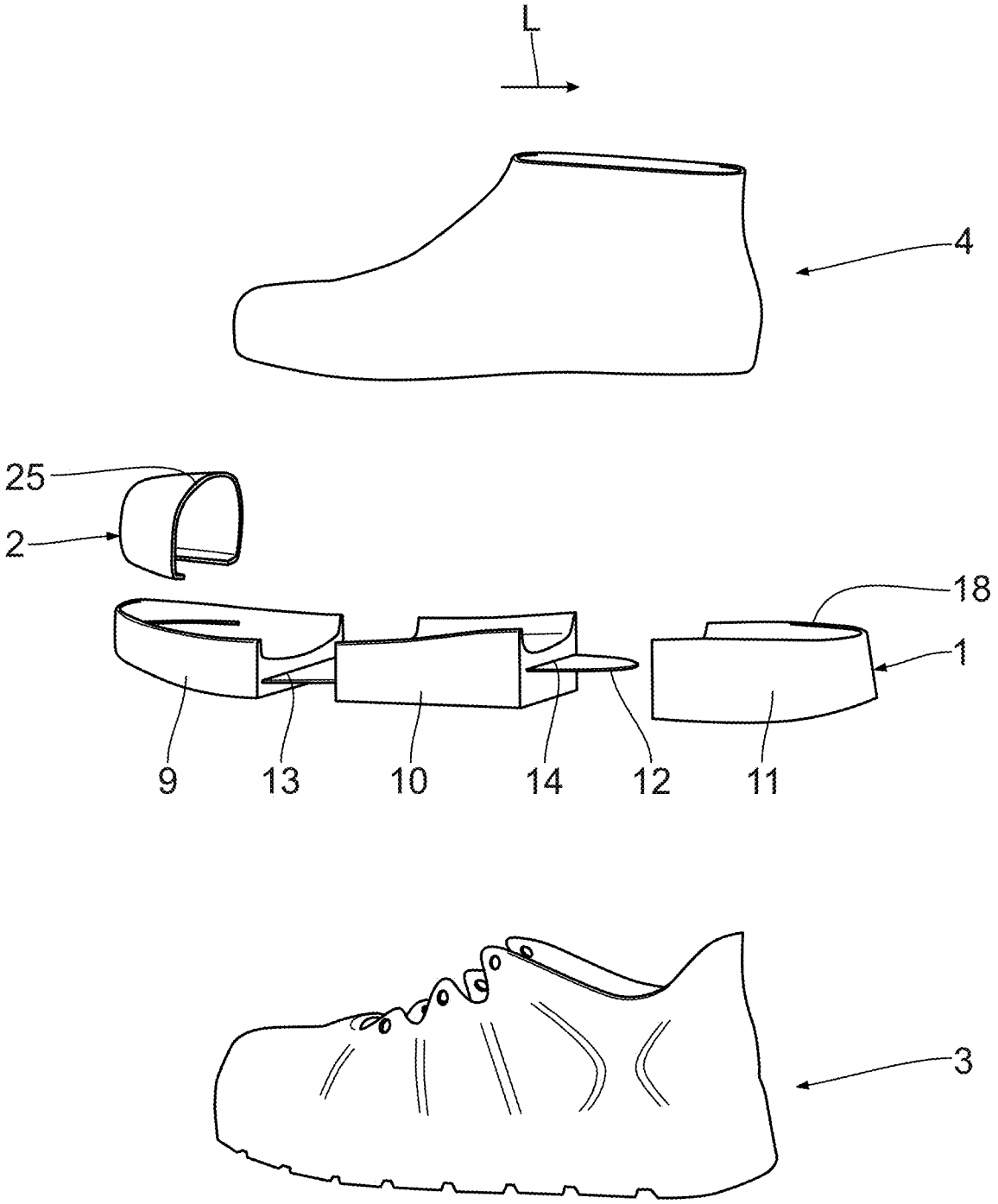
Figure 3:
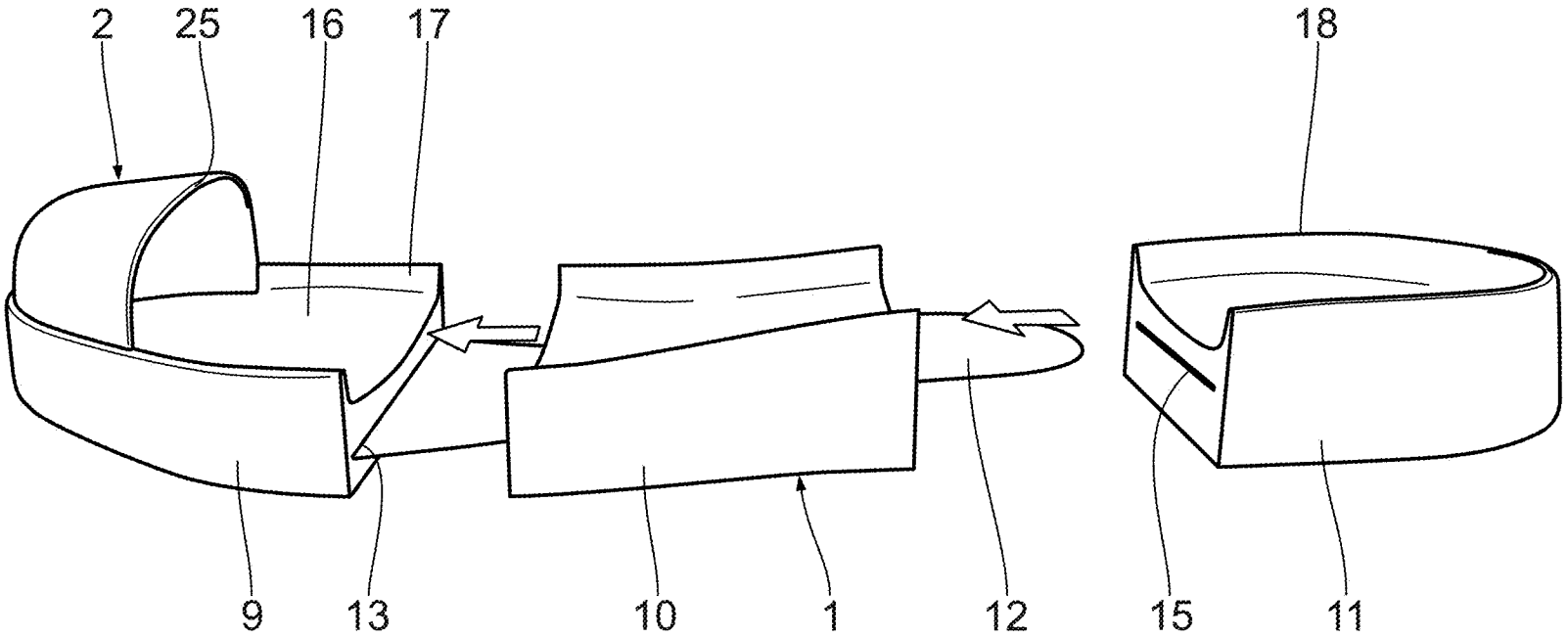
Figure 4:
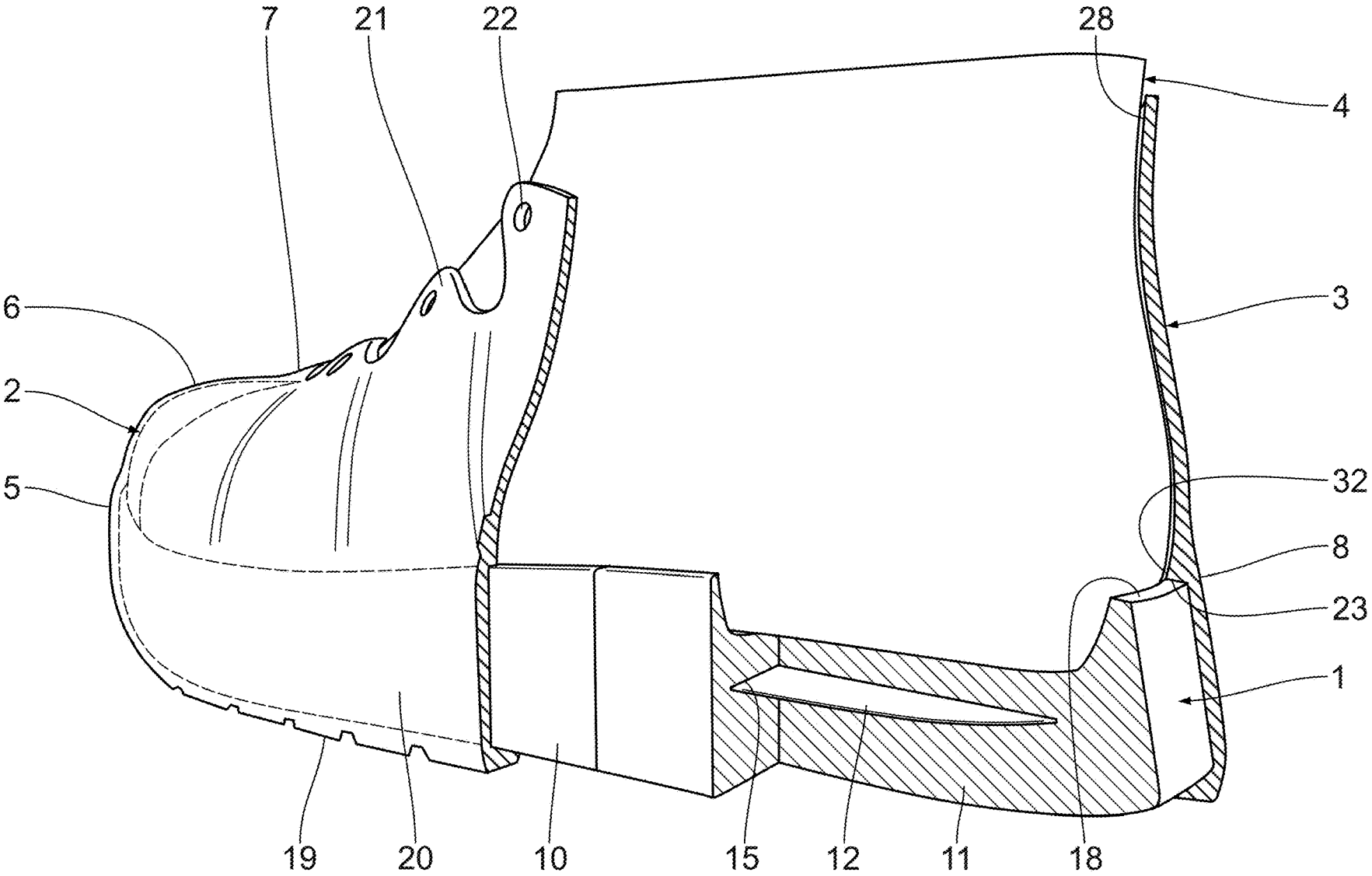
Figure 5:
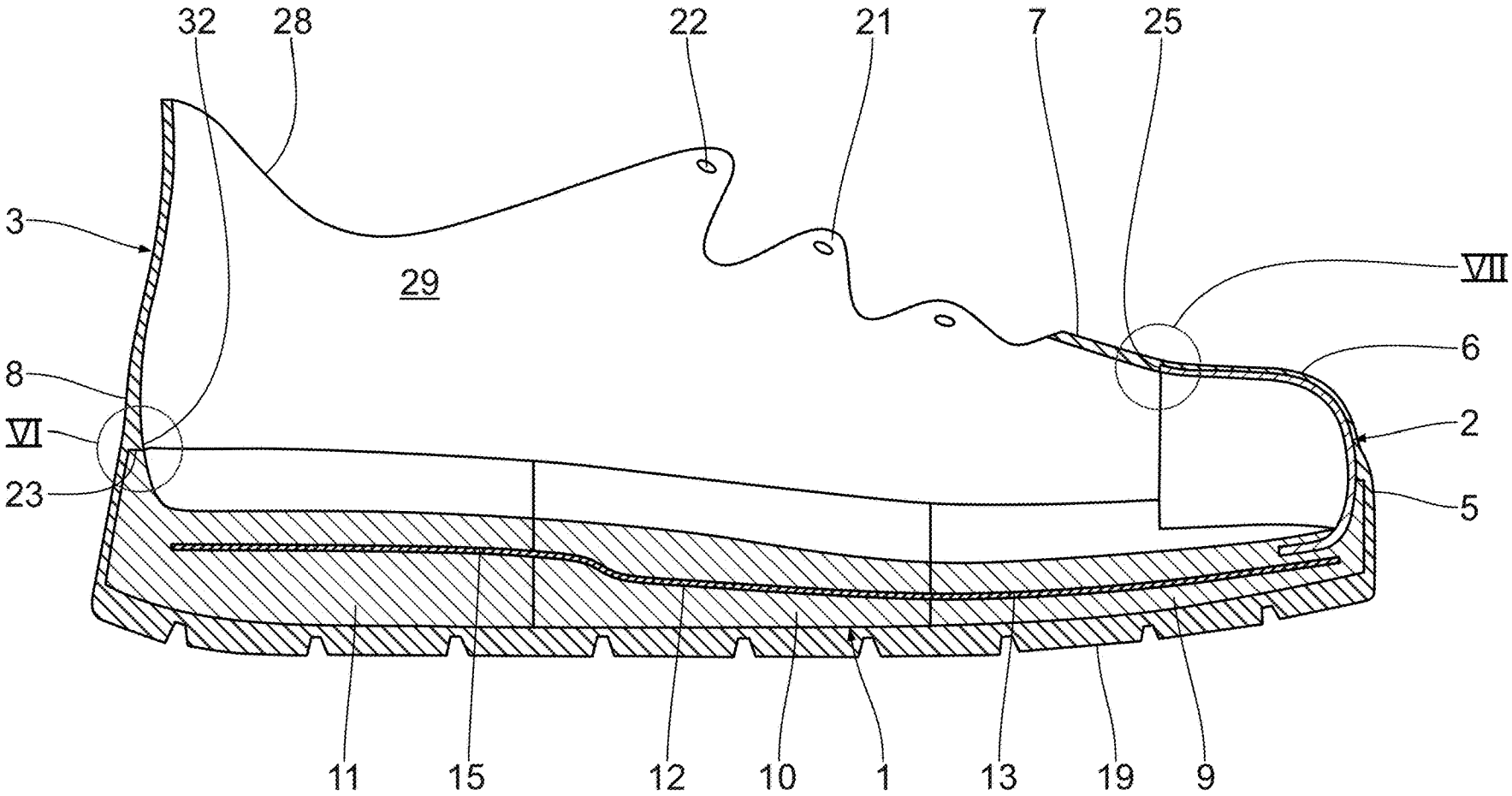
Figure 6:
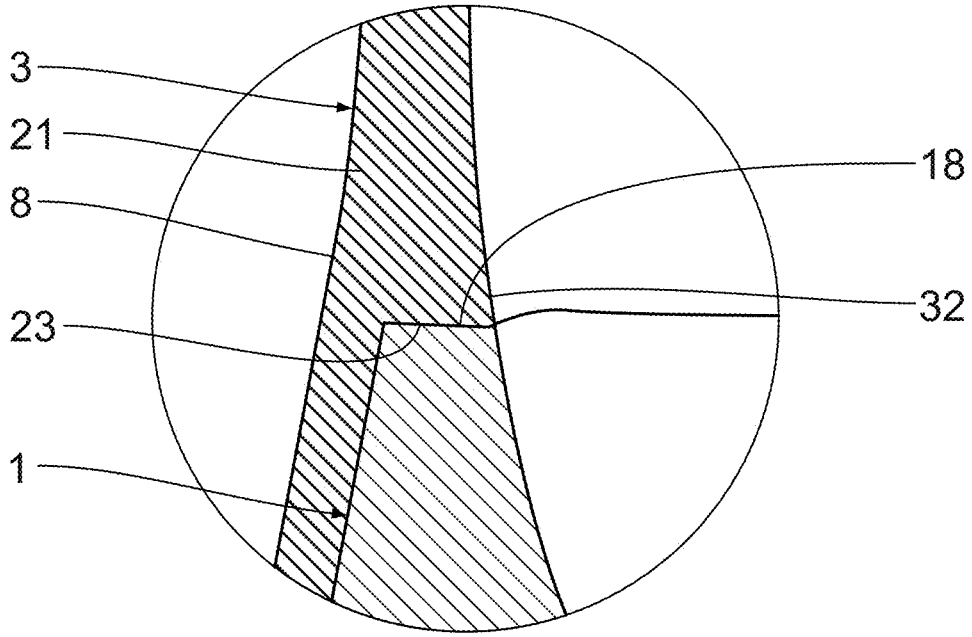
Figure 7:
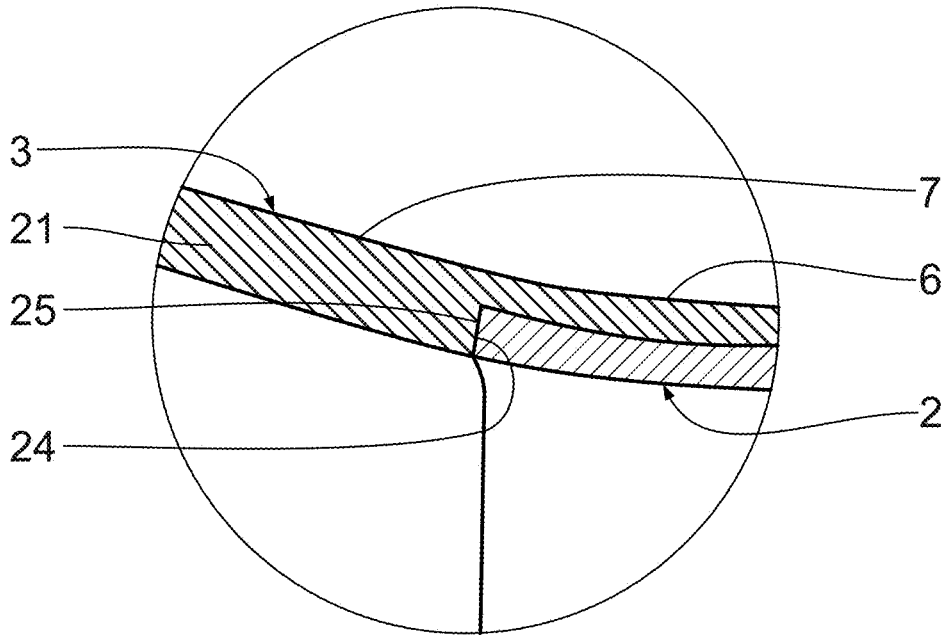
Figure 8:
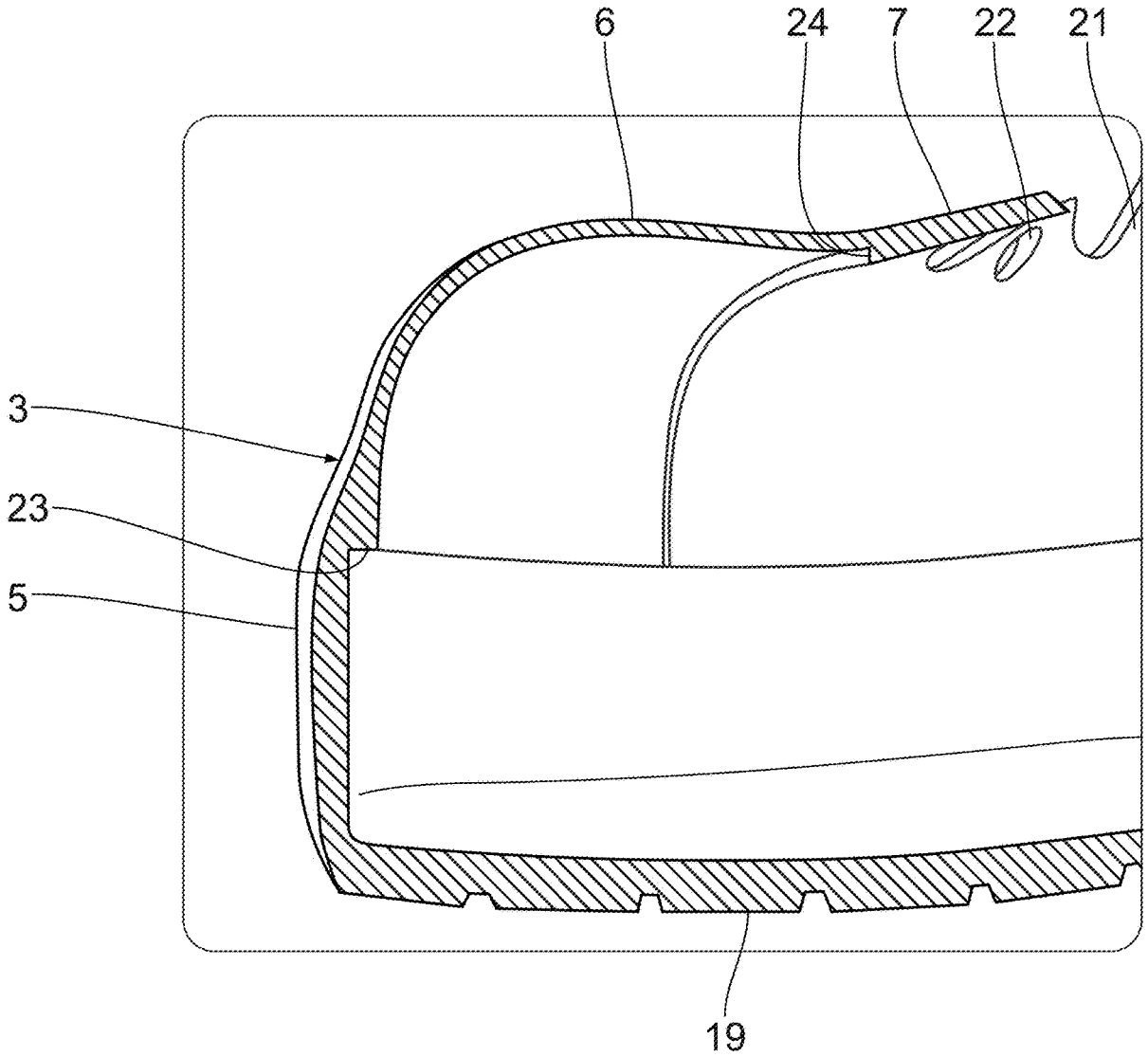
Figure 9:
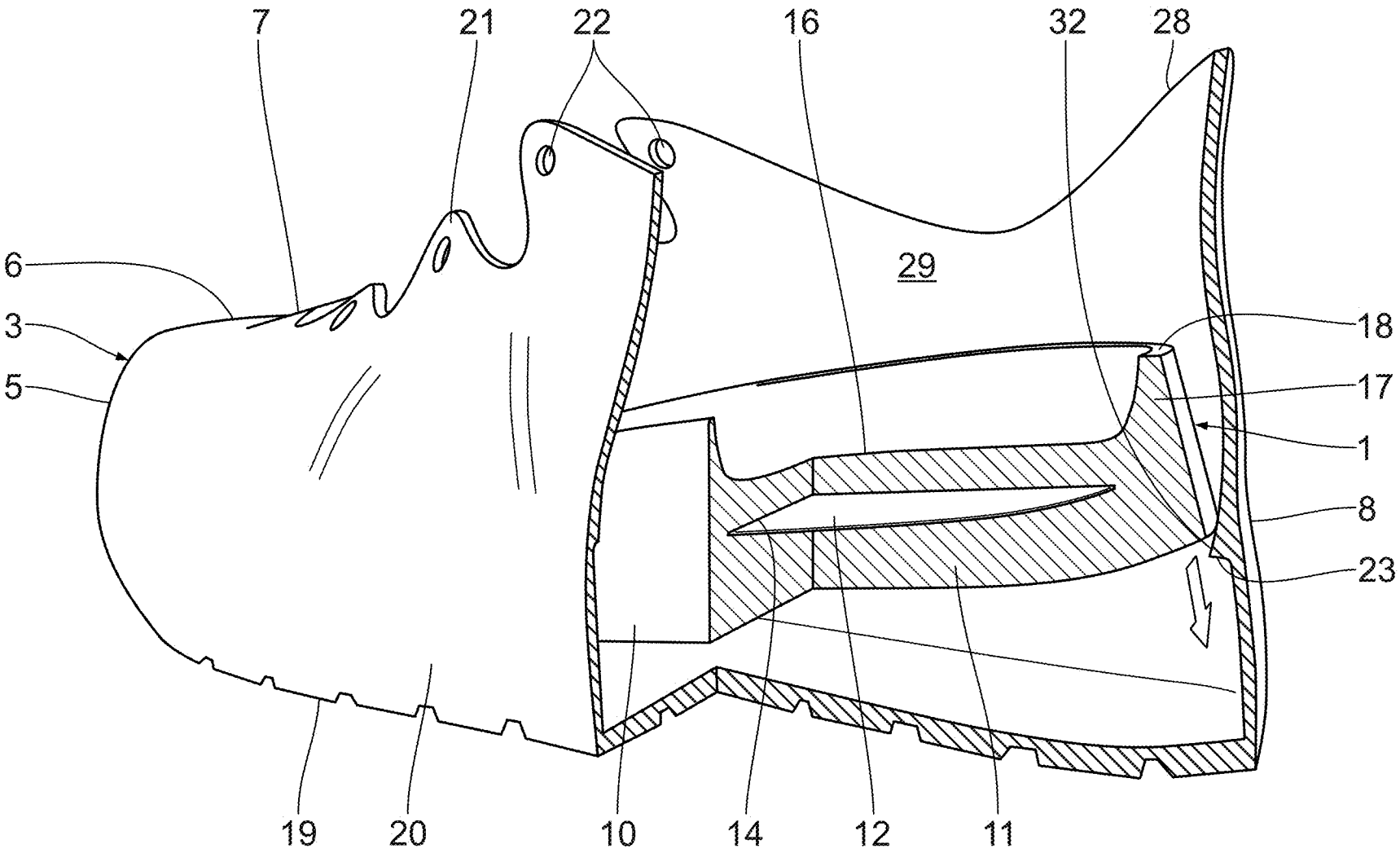
Figure 10:
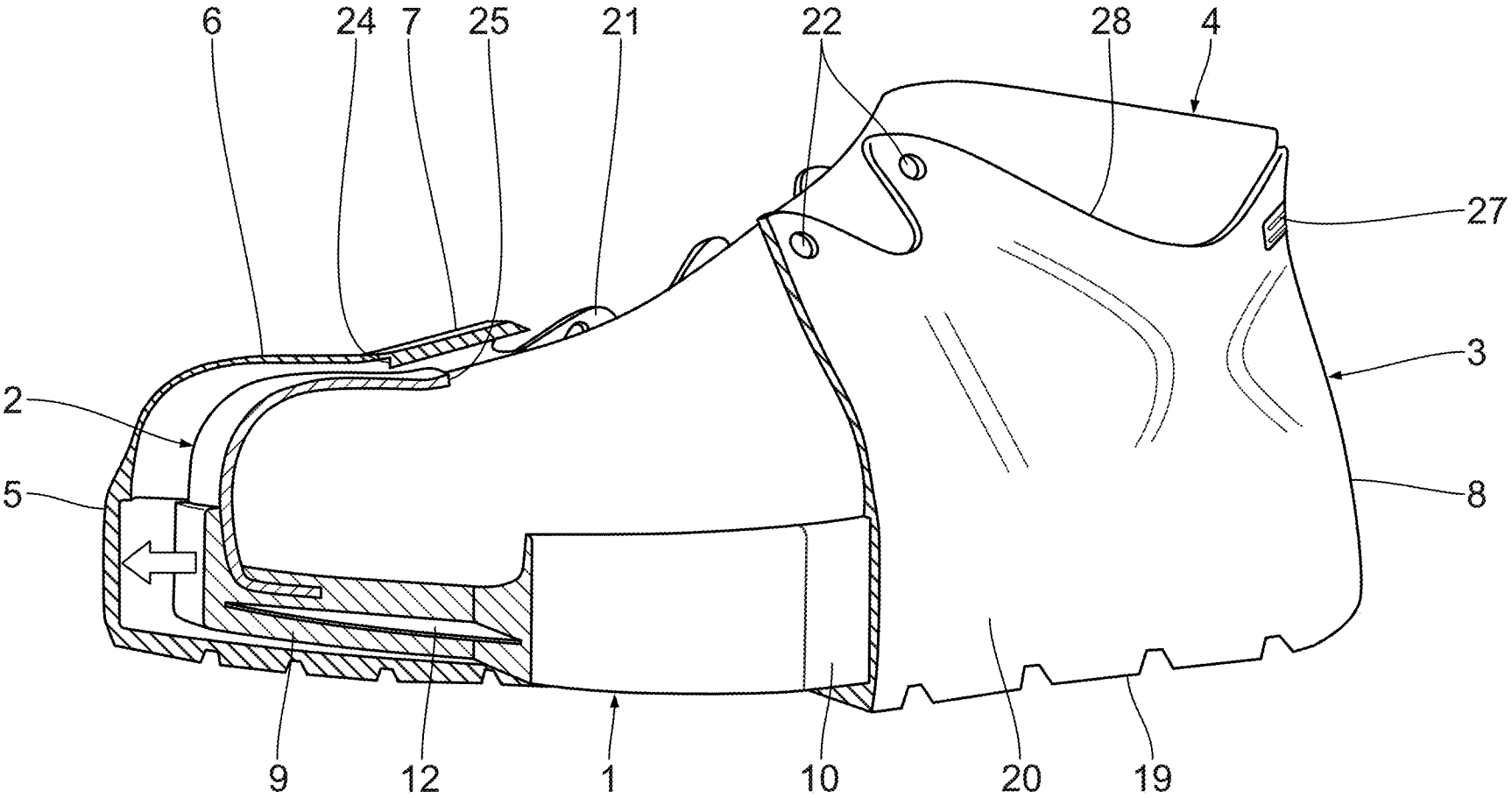
Figure 11:
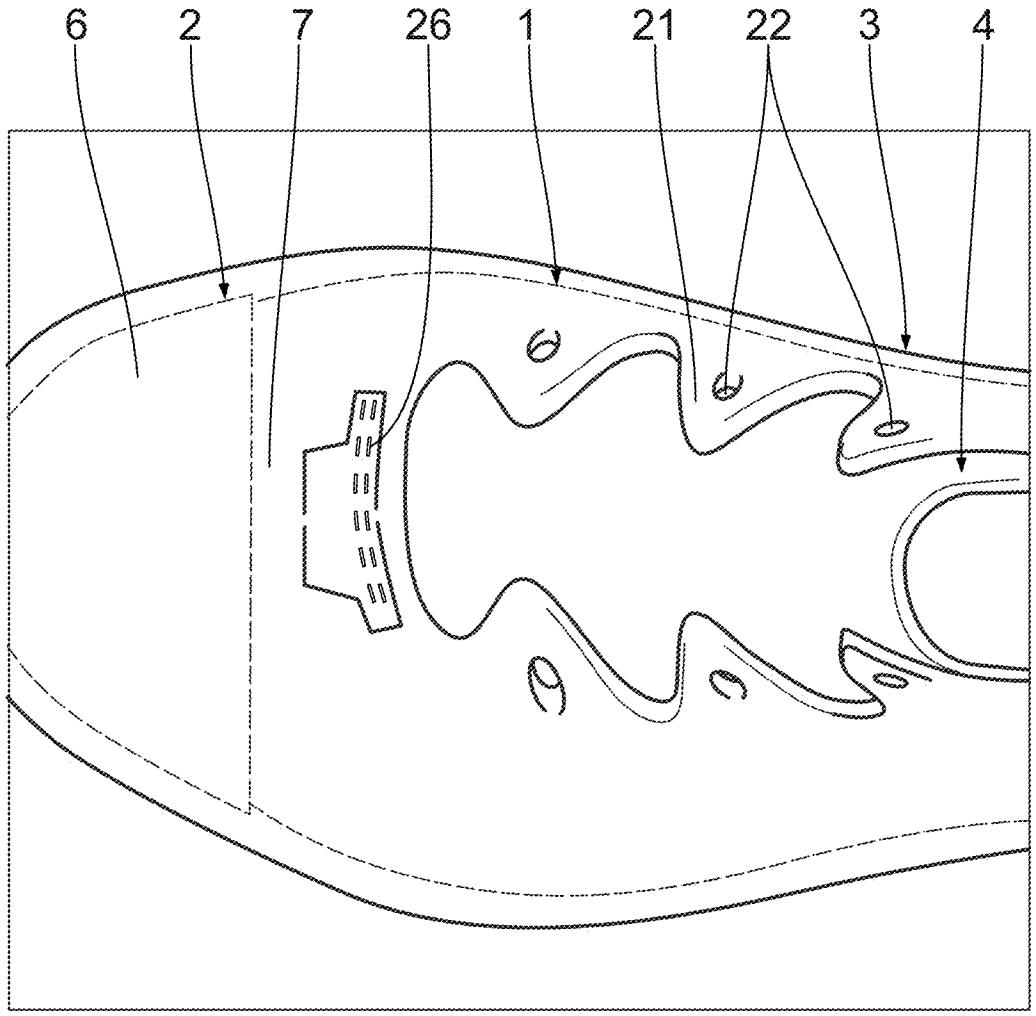
Figure 12:
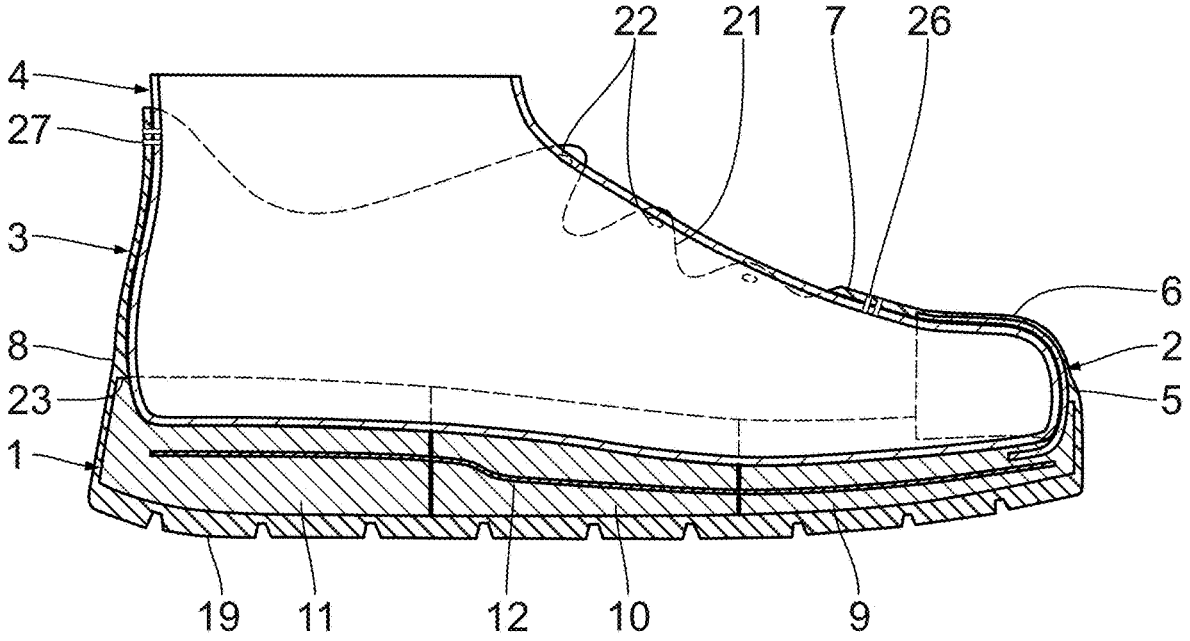
Figure 13:
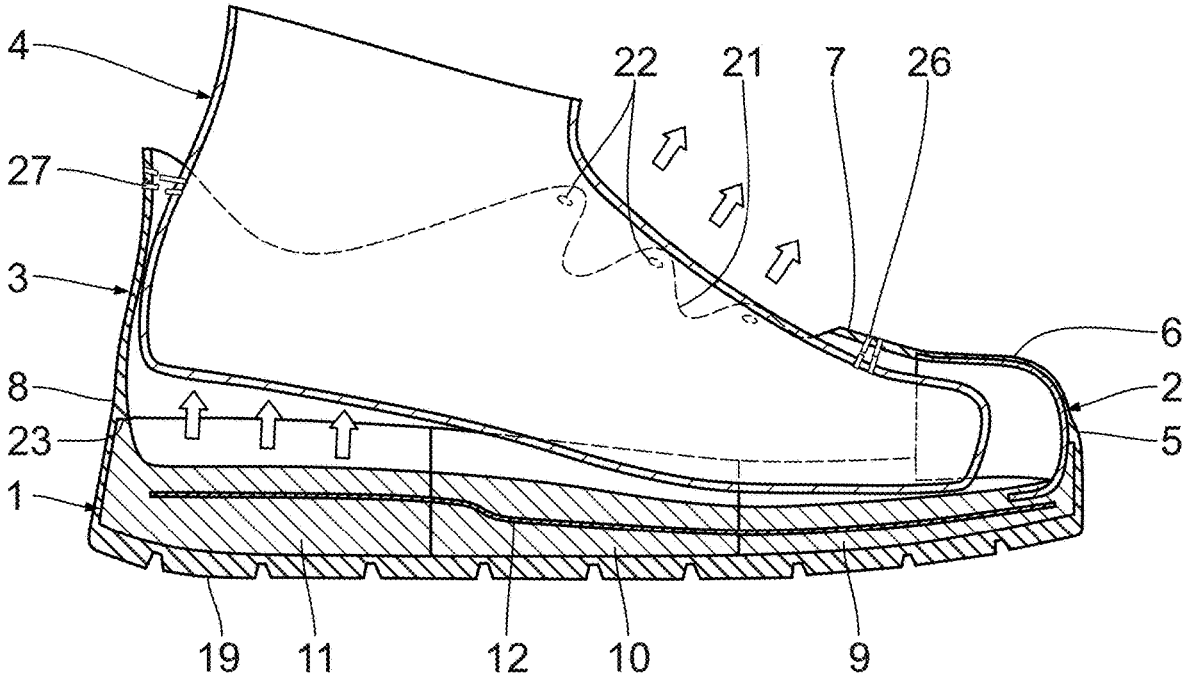

A preferred embodiment of the protective shoe is described by way of example below with reference to the appended drawing. In the figures:

FIG. 1 shows a side view of a protective shoe according to the invention in the assembled state, FIG. 2 shows an exploded view of the protective shoe shown in FIG. 1, FIG. 3 shows a midsole of the protective shoe depicted in FIGS. 1 and 2, which is also shown in FIG. 2, FIG. 4 shows the protective shoe depicted in FIGS. 1 and 2 in a partially cut-open illustration, FIG. 5 shows a longitudinal section through the illustrated protective shoe without an inner shoe, FIG. 6 shows an enlarged scale of the detail VI marked in FIG. 5, FIG. 7 shows an enlarged scale of the detail VII marked in FIG. 5, FIG. 8 shows a partial view, depicting in section an outer shell of the protective shoe shown, FIGS. 9, 10 show partially cut-open views of the protective shoe depicted, which show a mounting of the midsole, FIG. 11 shows a plan view of a front region of the outer shell of the protective shoe illustrated, which depicts a connecting and indicating arrangement, FIG. 12 shows a section through the protective shoe depicted, which also shows the inner shoe and the connecting and indicating arrangements, FIG. 13 shows a view corresponding to FIG. 12, which shows the dismantling of the inner shoe, and FIGS. 14-17 show perspective views of alternative outer shells of the protective shoe illustrated.

Firstly, in particular with reference to FIGS. 1, 2, 4, 10, 12 and 13, a protective shoe as a whole in the assembled state comprises a midsole 1 and a toe cap 2 arranged on the midsole 1, and also an outer shell 3, in which the midsole 1 and toe cap 2 are received or accommodated. The protective shoe moreover has an inner shoe 4, which in the assembled state of the protective shoe is received in the outer shell 3 and is supported at the top opposite the midsole 1. The inner shoe 4 delimits a foot (receiving) space of the protective shoe. It is preferably flexible.

The protective shoe has an elongate form and extends along a longitudinal direction L. It has a shoe tip 5 at the front, which is adjoined by a toe region 6 of the protective shoe. An instep region 7 of the protective shoe adjoins the toe region 6 in turn. The protective shoe has a heel region 8 opposite the shoe tip 5.

The midsole 1 has a multi-part form (see in particular FIGS. 2 and 3). It preferably has a cushioning design. The midsole 1 is subdivided in the longitudinal direction L into three midsole components, specifically a front midsole component 9, a middle midsole component 10 and a rear midsole component 11. The midsole components 9, 10, 11 are originally, which is to say before the assembly of the protective shoe or of the midsole 1, formed separately and apart from one another. They have different forms, in particular widths and/or thicknesses, and are preferably correspondingly fitted to a foot of the shoe's wearer (not illustrated). They for example have different hardnesses, or are made from different materials.

The front midsole component 9 is preferably rounded at the front. The front midsole component 9 is preferably (substantially) flat opposite thereto/at the rear. The rear midsole component 11 is preferably rounded at the rear. The rear midsole component 11 is preferably flat opposite thereto/at the front. The middle midsole component 10 is preferably flat both at the front and rear. A different number of midsole components 9, 10, 11, such as two, four or five, is alternatively possible.

The midsole components 9, 10, 11 are connected to one another, for example re-detachably or non-detachably, by a single, shared connecting element 12. The connecting element 12 is planar and thin. It expediently has a sole-like form. The connecting element 12 is preferably rigid and provides for example puncture resistance. The connecting element 12 has a width which varies perpendicularly to the longitudinal direction L. It is for example at least partially wider at the front than at the rear. It is preferably rounded at the front and at the rear. It is expedient if the connecting element 12 has a uniform thickness.

Each midsole component 9, 10, 11 has a connecting element receptacle. A front connecting element receptacle 13 is formed in the front midsole component 9 and a middle connecting element receptacle 14 is formed in the middle midsole component 10. A rear connecting element receptacle 15 is formed in the rear midsole component 11.

Each connecting element receptacle 13, 14, 15 is slot-like and spatially delimited upward and downward, and also laterally outward perpendicularly in relation to the longitudinal direction L. Each connecting element receptacle 13, 14, 15 has a height, which corresponds (substantially) to the thickness of the connecting element 12.

The front connecting element receptacle 13 is moreover forwardly spatially delimited. It is open to the rear, which is to say toward the middle midsole component 10, or the middle connecting element receptacle 14.

The rear connecting element receptacle 15 is rearwardly spatially delimited. It is open to the front, which is to say toward the middle midsole component 10, or the middle connecting element receptacle 14.

The middle connecting element receptacle 14 is open both to the front, which is to say toward the front midsole component 9, or the front connecting element receptacle 13, and to the rear, which is to say toward the rear midsole component 11, or the rear connecting element receptacle 15. It is continuous in the longitudinal direction L.

Mutually facing openings of the adjacently arranged connecting element receptacles 13, 14, 15 are at the same height in the assembled state of the midsole 1 and preferably have an identical width. They extend adjacent to one another and are in line with one another.

In the assembled state of the midsole 1, the connecting element 12 engages in the front connecting element receptacle 13 and rear connecting element receptacle 15. It passes all the way through the middle connecting element receptacle 14 and correspondingly protrudes beyond it on either side. The midsole components 9, 10, 11 are for example threaded or plugged on the connecting element 12.

In the assembled state of the midsole 1, the connecting element 12 preferably bears laterally outward against the respective midsole component 9, 10, and 11 at least partially in the respective connecting element receptacle 13, 14 and 15. It expediently bears at the front against the front midsole component 9 at least partially in the front connecting element receptacle 13 and at the rear against the rear midsole component 11 in the rear connecting element receptacle 15. It also preferably bears at least partially at the top and bottom against each midsole component 9, 10, 11.

In the assembled state of the midsole 1, moreover, the front midsole component 9 and the middle midsole component 10 bear in particular extensively against one another. The middle midsole component 10 and the rear midsole component 11 then bear correspondingly, in particular extensively, against one another.

The midsole components 9, 10, 11 are secured or fixed relative to one another in a vertical direction, which is to say upward and downward, and in a lateral direction, which is to say to the left and right, by the connecting element 12. They are preferably also fixedly held together, or fixed relative to one another in the longitudinal direction L.

For example, the connecting element 12 is at least partially wetted with a release agent, in order to make it possible to remove the midsole components 9, 10, 11 from one another, or from the connecting element 12.

According to a preferred embodiment, the connecting element 12 is injection molded in the midsole components 9, 10, 11. As an alternative, it is encapsulated with midsole material by injection molding to form the midsole components 9, 10, 11.

Around the edge, the midsole 1 has an outer edge 17 which projects upward from an upwardly facing sole face 16 and is peripherally closed, and thus endless, in the assembled state of the midsole 1. The outer edge 17 has an upwardly pointing free top face 18. Each midsole component 9, 10, 11 has at least one corresponding partial outer edge.

The toe cap 2 is arranged at the top and at the front of the front midsole component 9. It is rigid. The toe cap 2 is closed to the front, upward and to the side. It is open to the rear. For example, the toe cap 2 is injection molded directly on/in the front midsole component 9. For example, it is at least partially wetted before the injection molding operation with a release agent, in order to allow the toe cap 2 and the front midsole component 9 to be separated later on. As an alternative, the toe cap 2 and the front midsole component 9 are non-detachably connected to one another. As an alternative, the toe cap 2 is originally designed separately and correspondingly arranged on the front midsole component 9.

In the assembled state of the protective shoe, the inner shoe 4 engages in the toe cap 2 from behind. The inner shoe 4 is supported at the top with its inner shoe sole facing the sole face 16. The outer edge 17 surrounds or encircles the inner shoe 4 completely to the side at the bottom. It at least partially bears against the inner shoe 4. The inner shoe 4 is thus spatially fixed longitudinally and laterally relative to the midsole 1.

In the assembled state of the protective shoe, the inner shoe 4 together with the midsole 1 and the toe cap 2 is surrounded by the outer shell 3, which forms an outer skin. The inner shoe 4 and the outer shell 3 at least partially bear against one another.

The outer shell 3 at the bottom forms an outsole 19, which, when the protective shoe is being worn by the shoe's wearer, makes direct contact with and ensures sufficient grip on a floor or ground (not illustrated). In the assembled state of the protective shoe, the outsole 19 extends at the bottom over the entire midsole 1 and has for example a profile on the bottom.

Expediently, it is slip-proof, heat resistant, flexible under cold conditions, cold-insulating, cut-resistant and/or anti-static. It is expedient if it is highly resistant to wear. The midsole 1 and the outsole 19 form a sole arrangement of the protective shoe.

The outer shell 3 moreover has/forms a sole outer wall 20, which adjoins the top of the outsole 19 around the edge and, in the assembled state of the protective shoe, completely surrounds the midsole 1 peripherally, or to the side. The sole outer wall 20 and the midsole 1 at least partially bear against one another. There is for example an angle from 85° to 95° between the outsole 19 and the sole outer wall 20.

The outer shell 3 moreover has an outer material 21 of the upper that adjoins the top of the sole outer wall 20 and, in the assembled state of the protective shoe, at least partially peripherally surrounds the inner shoe 4. The outer material 21 of the upper and the inner shoe 4 at least partially bear against one another. The inner shoe 4 is for example higher than the outer material 21 of the upper. The outer material 21 of the upper and/or the inner shoe 4 form an upper of the protective shoe.

A closure arrangement 22 is arranged on the outer material 21 of the upper in the instep region 7. The closure arrangement 22 is in this case in the form of an eyelet arrangement with a multiplicity of eyelets for lacing the protective shoe. Other closure arrangements, such as hook-and-loop closure arrangements, can alternatively be used.

In the assembled state of the protective shoe, the outer shell 3 has, on the inside adjacent to the top face 18 of the midsole 1, an, in particular single, downwardly facing, free first latching surface 23 (FIGS. 4, 5 and 6), which is thus arranged in a transition region between the sole outer wall 20 and the outer material 21 of the upper. The first latching surface 23 is peripherally closed and thus endless. It is arranged at a spacing from and faces toward the outsole 19. The first latching surface 23 forms an angle of between 80° and 100° for example with the sole outer wall 20.

The top face 18 forms a mating latching surface for the first latching surface 23.

The outer shell 3 or the outer material 21 of the upper has, on the inside adjacently above the first latching surface 23, a mounting insertion aid 32, which like the first latching surface 23 is peripherally closed and endless. The mounting insertion aid 32 extends along the entire first latching surface 23. In the region of the mounting insertion aid 32, the outer material 21 of the upper thickens from top to bottom continuously to form the first latching surface 23 and to form an insertion bevel. The insertion bevel projects from the top inward. The first latching surface 23 is not spatially delimited laterally inward, which is to say toward the inner shoe 4 or foot space. It is spatially delimited laterally outward, which is to say away from the inner shoe 4 or foot space.

The outer material 21 of the upper moreover has an, in particular single, free, second latching surface 24 (FIGS. 5 and 7), which faces forward and extends in an are. In the assembled state of the protective shoe, the second latching surface 24 adjoins the top of the midsole 1, in particular its top face 18, and is continuous. It projects inward and is not spatially delimited inward, which is to say toward the inner shoe 4 or foot space. It is spatially delimited laterally outward, which is to say away from the inner shoe 4 or foot space. The outer material 21 of the upper is thinner in the region of the toe cap 2 than behind it.

A free, which is to say rear edge 25, facing away from the shoe tip 5, of the toe cap 2 forms a mating latching surface for the second latching surface 24.

In the instep region 7, the protective shoe moreover has a first sealing seam arrangement 26 (FIGS. 1, 11, 12 and 13), which in the assembled state of the protective shoe extends in a width direction thereof between the closure arrangement 22 and the toe cap 2. The first sealing seam arrangement 26 has two substantially parallel, elongate sealing seams, which form a fixed, but detachable or destructible connection between the outer shell 3 and the inner shoe 4. It is visible from the outside. It forms a connecting and indicating arrangement.

The protective shoe also has a second sealing seam arrangement 27 (FIGS. 1, 12 and 13), which is formed (substantially) like the first sealing seam arrangement 26. The second sealing seam arrangement 27 is arranged at the top in a heel region 8 of the protective shoe and extends peripherally there. It again forms a fixed, but detachable or destructible connection between the outer shell 3 and the inner shoe 4. It is visible from the outside. It forms a connecting and indicating arrangement.

The assembly of the protective shoe is described in more detail below.

As shown in FIG. 9, in the assembled state, the midsole 1 is manually or automatedly inserted, in the form of a unit including the toe cap 2, from above into the inner space 29 of the outer shell 3 through an upper opening 28 in the outer shell. This is done leading with the front midsole component 9. The sole face 16 or top face 18 faces upward. The midsole 1 is guided such that, at the front, its top face 18 engages underneath the first latching surface 23. The midsole 1 is preferably inclined forwardly downward in so doing.

When the top face 18 engages underneath the first latching surface 23 at the front, the unit composed of the midsole 1 and toe cap 2 is displaced or pivoted downward at the rear, with the result that said unit also comes closer to the outsole 19 there.

In the process, the outer shell 3 is pressed laterally outward, for example all around the periphery, adjacent to the first latching surface 23 by the midsole 1 owing to the pre-arranged mounting insertion aid 32. As soon as the midsole 1 is underneath the first latching surface 23, the first latching surface 23 latches or springs over the top face 18, which forms a mating latching surface. The first latching surface 23 then engages over and is located above the top face 18. They at least partially extensively bear against one another. The outer shell 3 and the midsole 1 are in a latching or snap-action connection with one another. The midsole 1 is in particular upwardly fixed by this latching connection. The midsole 1 at least partially bears against the inside of the sole outer wall 20 of the outer shell 3. It at least partially rests on the top of the outsole 19.

When the unit composed of the midsole 1 and toe cap 2 is being inserted, the toe cap 2 presses the outer shell 3 or the outer material 21 of the upper laterally outward and upward adjacent to the second latching surface 24. As soon as the toe cap 2 has passed the second latching surface 24, the second latching surface 24 latches or springs over the edge 25 of the toe cap 2, which forms a mating latching surface. They at least partially extensively bear against one another. The outer shell 3 and the toe cap 2 are in a latching or snap-action connection with one another. The toe cap 2 and the midsole 1 are fixed in particular rearwardly toward the heel region 8 by this latching connection. The toe cap 2 at least partially bears against the inside of the outer material 21 of the upper of the outer shell 3.

The front midsole component 9, together with the toe cap 2, is situated in the toe region 6 of the protective shoe. The rear midsole component 11 is situated in the heel region 8 of the protective shoe. The middle midsole component 10 is situated in between.

Then, the first and the second sealing seam arrangement 26, 27 are created. The sealing seam arrangements 26, 27 each establish a fixed, but detachable seam connection between the outer shell 3, or the outer material 21 of the upper, and the inner shoe 4, this seam connection spatially fixing the inner shoe 4 in the outer shell 3. They are each connected, in particular directly, both to the outer shell 3 and to the inner shoe 4.

Then, the inner shoe 4 is inserted. As an alternative, the inner shoe 4 is inserted together with the unit composed of the midsole 1 and toe cap 2.

A wearer of the shoe can then use the protective shoe normally. Their toes engage in the toe cap 2 from behind and are situated in the toe region 6 of the protective shoe. Their heel is situated in the heel region 8 of the protective shoe.

When the protective shoe is being dismantled, firstly the inner shoe 4 is taken out of the outer shell 3. In the process, the sealing seam arrangements 26, 27 tear open and are thus destroyed (FIG. 13). They thus indicate dismantling of the protective shoe, and this can be identified from the outside. The protective shoe loses its compliance with standards and also guarantee, and this is correspondingly identifiable or indicated.

Then, the unit composed of the midsole 1 and toe cap 2 can be removed from the outer shell 3. For this, the latching connections are detached, for example manually, in particular by respectively lifting off the mutually assigned latching surfaces 23, 24 and mating latching surfaces 18, 25, in particular by applying corresponding external forces or moving them relative to one another.

If designed to do so, the midsole components 9, 10, 11 can then be separated from one another. On separating them from one another, the connecting element 12 is released again.

The inner shoe 4 can thus be recycled individually. The outer shell 3 can also be recycled individually. The midsole components 9, 10, 11 can also be recycled individually or together. The connecting element 12 can also be recycled individually.

As depicted in FIGS. 14 to 17, the outer shell 3 may have a different design.

Figure 14:
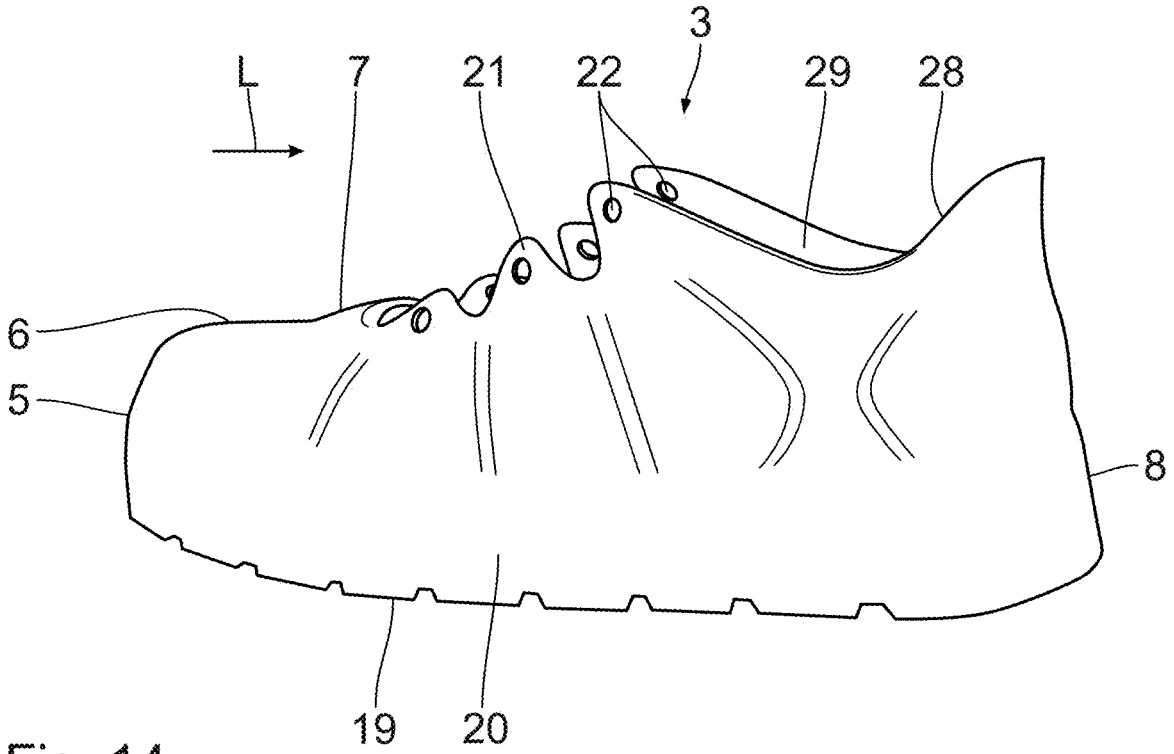

According to FIG. 14, the outer shell 3 is closed in a region of the upper. It is injection molded, for example from TPU (thermoplastic polyurethane), and expediently waterproof.

Figure 15:
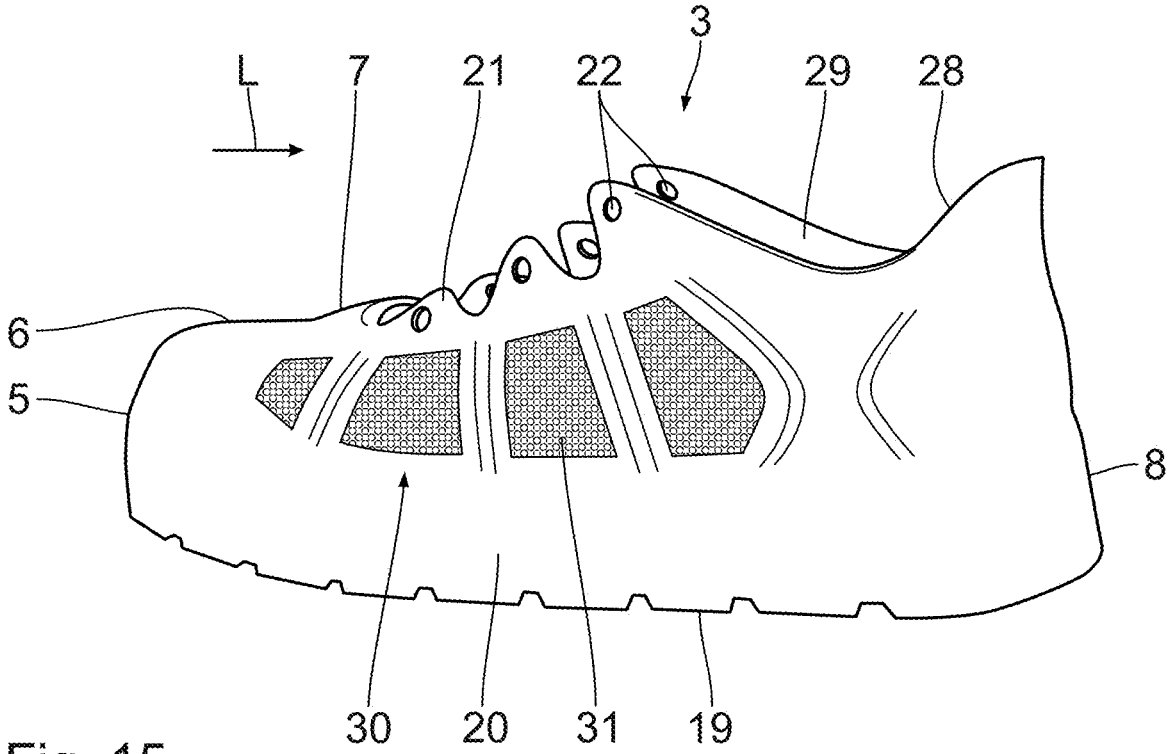

According to FIG. 15, the outer shell 3 has multiple windows 30 in the region of the upper. The windows are closed by at least one interwoven fabric 31. The at least one interwoven fabric 31 preferably, like the rest of the outer shell 3, consists of TPU.

Figure 16:
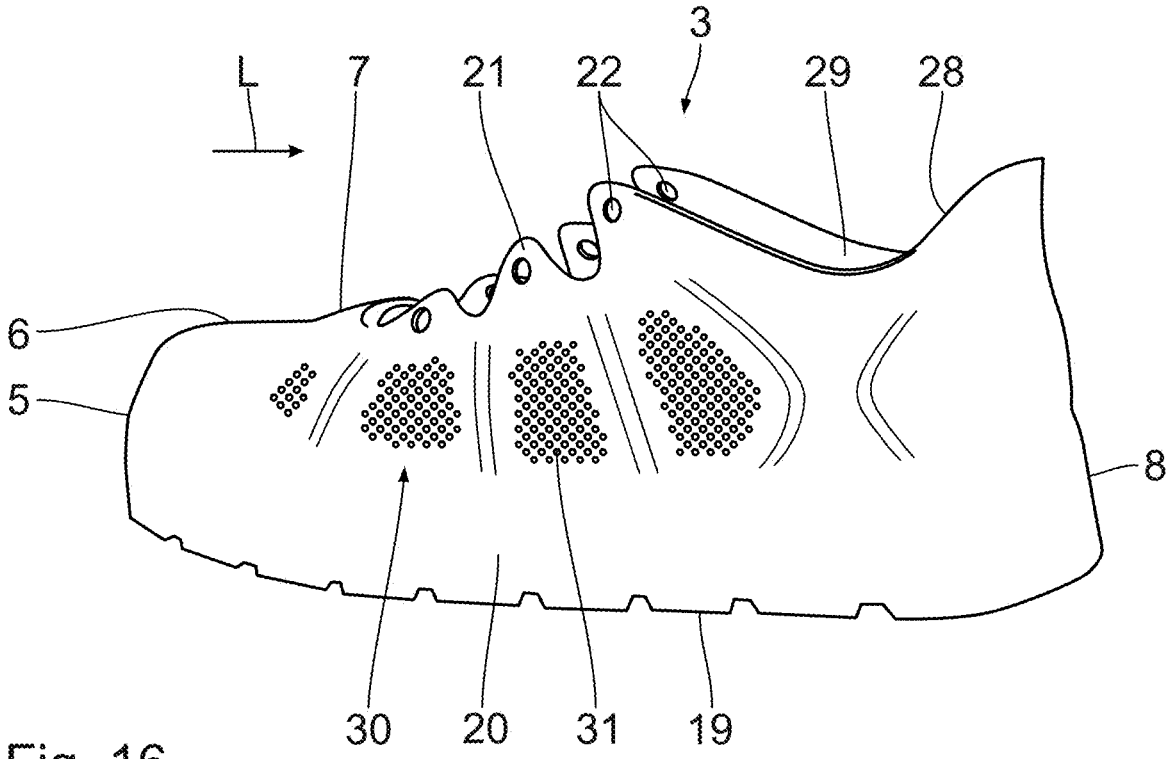

According to FIG. 16, the outer shell 3 is perforated to form windows 30 in the region of the upper. The perforations are for example smaller and/or larger than openings in the at least one interwoven fabric 31. They have for example different sizes and/or forms.

Figure 17:
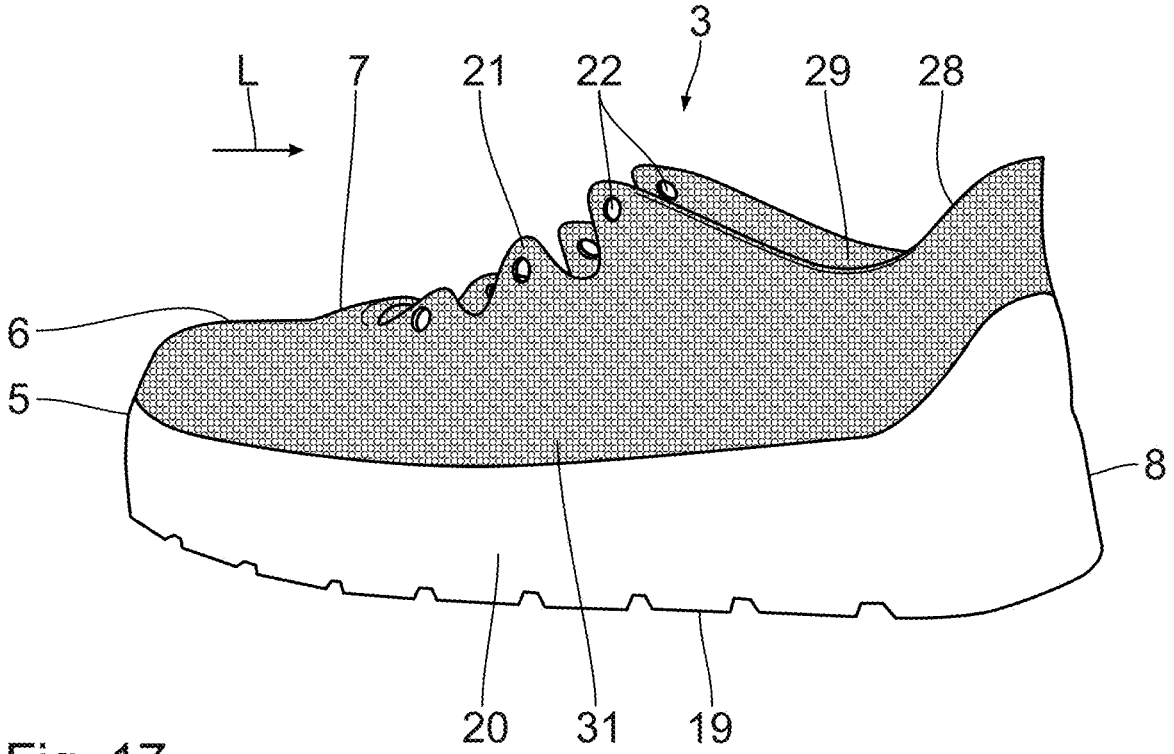

According to FIG. 17, the outer shell 3 comprises an interwoven fabric, which consists for example of TPU, throughout the region of the upper.

The terms used here "front", "rear", "behind", "top", "bottom" or the like relate to a protective shoe which has its sole arrangement on a floor or is worn as intended by a wearer. The toe region 6, or the shoe tip 5, is situated as is conventional for example at the front. The heel region 8 is situated for example at the rear. The outsole 19 is situated on the bottom.

The invention claimed is:

1. A protective shoe, which is completely assembled in an original, integral state and configured to be dismantled for recycling purposes, comprising:
   a) an upper for receiving a shoe wearer's foot,
   b) a sole arrangement connected to the upper,
   c) a toe cap, and
   d) at least one seal, which,
      i) forms a connection in a form of a predetermined breaking point between two dismantlable components of the protective shoe, wherein the seal has a strength which is lower than a strength of an additional connection between the two dismantlable components,
      ii) in the original, integral state, indicates an integrity of the protective shoe, and
      iii) when the protective shoe is dismantled, at least partially tears open to indicate that the protective shoe has been dismantled.

2. The protective shoe as claimed in claim 1, wherein when the protective shoe is dismantled, the seal is in a state that indicates a removal of at least one of the toe cap, an inner shoe or the sole arrangement.

3. The protective shoe as claimed in claim 1, wherein the seal comprises at least one sealing seam, which can be clearly identified as a seal by a special seam colour.

4. The protective shoe as claimed in claim 1, wherein the seal has an elongated shape.

5. The protective shoe as claimed in claim 1, wherein the seal is arranged on at least one of a group consisting of an inner shoe and an outer shell of the protective shoe.

6. The protective shoe as claimed in claim 1, wherein, in the original, integral state, the seal fixedly, but detachably connects an inner shoe and an outer shell of the protective shoe to one another.

7. The protective shoe as claimed in claim 1, wherein when the protective shoe has been dismantled, the seal is in a state that indicates a removal of at least one of the group consisting of a midsole of the sole arrangement and a unit composed of the toe cap and the midsole.

8. The protective shoe as claimed in claim 1, further comprising at least one first seal, which is arranged adjacent to the toe cap in an instep region of the protective shoe.

9. The protective shoe as claimed in claim 8, wherein the at least one first seal is spaced apart from the toe cap.

10. The protective shoe as claimed in claim 8, wherein the at least one first seal is arranged in the instep region between the toe cap and a closure arrangement.

11. The protective shoe as claimed in claim 1, further comprising at least one second seal, which is arranged in a rear region of the protective shoe.

12. The protective shoe as claimed in claim 11, wherein the at least one second seal is arranged adjacent to an upper free edge of the upper.

13. The protective shoe as claimed in claim 1, wherein the two dismantlable components are structurally connected to one another by a connection independent of the seal.

14. The protective shoe as claimed in claim 1, wherein the at least one seal comprises a sealing seam.

15. A protective shoe that is completely assembled in an original, integral state is designed to be dismantled for recycling purposes, comprising:

a) an upper for receiving a shoe wearer's foot, b) a sole arrangement connected to the upper, c) a toe cap, and d) at least one seal, which, i) forms a connection in the form of a predetermined breaking point between two dismantlable components of the protective shoe, ii) in the original, integral state, indicates an integrity of the protective shoe, and iii) when the protective shoe is dismantled, at least partially tears open to indicate that the protective shoe has been dismantled, iv) wherein the seal comprises at least one sealing seam, having a special seam colour.

* * * * *